US006384527B1

(12) United States Patent
Spindt et al.

(10) Patent No.: US 6,384,527 B1
(45) **Date of Patent: *May 7, 2002**

(54) FLAT PANEL DISPLAY WITH REDUCED ELECTRON SCATTERING EFFECTS

(75) Inventors: Christopher J. Spindt, Menlo Park; John E. Field, Hillsborough; Duane A. Haven, Cupertino, all of CA (US)

(73) Assignee: Candescent Technologies Corporation, San Jose, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/560,166

(22) Filed: Nov. 20, 1995

Related U.S. Application Data

(63) Continuation-in-part of application No. 08/343,803, filed on Nov. 21, 1994, now Pat. No. 5,543,683.

(51) Int. Cl.[7] ..... H01J 19/24; H01J 19/82

(52) U.S. Cl. ..... 313/496; 313/422; 313/313; 313/326; 315/366; 315/17

(58) Field of Search ..... 313/422, 402, 313/479, 466, 326, 313, 496, 238, 239, 242, 495; 174/35 MS; 315/366, 17, 370

(56) References Cited

U.S. PATENT DOCUMENTS

| | | | | |
|---|---|---|---|---|
| 3,814,629 A | * | 6/1974 | Hansen et al. | 313/466 X |
| 4,472,658 A | * | 9/1984 | Morimoto et al. | 313/313 X |
| 5,012,155 A | * | 4/1991 | Datta et al. | 313/466 X |
| 5,378,962 A | | 1/1995 | Gray et al. | 313/495 |
| 5,477,105 A | * | 12/1995 | Curtin et al. | 313/466 X |
| 5,498,925 A | * | 3/1996 | Bell et al. | 313/497 |
| 5,508,584 A | | 4/1996 | Tsai et al. | 313/497 |
| 5,532,548 A | * | 7/1996 | Spindt et al. | 313/422 |
| 5,543,683 A | * | 8/1996 | Haven et al. | 313/466 X |
| 5,844,360 A | | 12/1998 | Jeong et al. | 313/495 |

FOREIGN PATENT DOCUMENTS

| | | | |
|---|---|---|---|
| EP | 0 631 295 A3 | 12/1994 | H01J/9/18 |
| EP | 0 635 865 A1 | 1/1995 | H01J/31/12 |
| WO | WO 94/18694 | 8/1994 | H01J/63/02 |
| WO | WO 96/16429 | 5/1996 | H01J/31/12 |

OTHER PUBLICATIONS van Oekel, J.J., "P–14: Improving the Contrast of CRTs under Low Ambient Illumination with a Graphite Coating", SID International Symposium Digest of Technical Papers, ISSN 0097–966X, Santa Ana, CA, May 1995, pp. 427–430.

* cited by examiner

*Primary Examiner*—Ashok Patel
(74) *Attorney, Agent, or Firm*—Wilson Sonsini Goodrich & Rosati

(57) ABSTRACT

A flat panel display is disclosed which includes a faceplate with a faceplate interior side, and a backplate including a backplate interior side in an opposing relationship to the faceplate interior side. Side walls are positioned between the faceplate and the backplate. The side walls, faceplate and backplate form an enclosed sealed envelope. A plurality of phosphor subpixels are positioned at the faceplate interior side. A plurality of field emitters are positioned at the backplate interior side. The field emitters emit electrons which strike corresponding phosphor subpixels. A plurality of scattering shields surround each phosphor subpixel and define a subpixel volume. The scattering shields reduce the number of scattered electrons exiting from their corresponding subpixel volume. This reduces the number of scattered electrons from charging internal insulating surfaces in the envelope, as well as striking the non-corresponding phosphor subpixels.

36 Claims, 6 Drawing Sheets

FLAT PANEL DISPLAY WITH REDUCED ELECTRON SCATTERING EFFECTS

CROSS-REFERENCE TO RELATED APPLICATIONS

This is a continuation-in-part of U.S. patent application Ser. No. 08/343,803, filed Nov. 21, 1994, entitled "FACEPLATE FOR FIELD EMISSION DISPLAY INCLUDING WALL GRIPPER STRUCTURES" now U.S. Pat. No. 5,543,683.

BACKGROUND

1. Field of the Invention

This invention relates to flat panel displays, more particularly to flat panel displays with scattering shields surrounding phosphor subpixels defining subpixel volumes which substantially reduce the number of scattered electrons that exit from their corresponding subpixel volume and (i) charge display internal structures that have insulating surfaces, (ii) strike non-corresponding phosphor subpixels or (iii) reenter other subpixel volumes.

2. Description of the Related Art

Field emission devices include a faceplate, a backplate and connecting walls around the periphery of the faceplate and backplate forming a sealed vacuum envelope. Generally in field emission devices the envelope is held at vacuum pressure, which in the case of CRT displays is about $1\times10^{-7}$ torr or less. The interior surface of the faceplate is coated with light emissive elements, such as phosphor or phosphor patterns, which define an "active region" of the display. Cathodes (field emitters) located adjacent to the backplate, are excited to release electrons that are accelerated toward the phosphor on the faceplate, striking the phosphor, and causing the phosphor to emit light seen by the viewer at the exterior of the faceplate. Emitted electrons from each field emitter are intended to strike only a certain targeted phosphor subpixel. There is generally a one-to-one correspondence between each group of emitters and a phosphor subpixel or a small number of phosphor subpixels for each group of emitters.

Flat panel displays are used in applications where the form-factor of a flat display is required. These applications are typically where there are weight constraints and the space available for installation is limited, such as in aircraft or portable computers.

A certain level of color purity and contrast is needed in CRT displays. Contrast is the comparative difference between dark and bright areas. The higher the contrast, the better. The parameters of resolution, color-purity and contrast in CRT displays depend on the precise communication of selected electron emitters with corresponding phosphor pixels.

High picture brightness, as measured in nits, requires either high power consumption or high phosphor efficiency.

High power consumption in many applications is not acceptable. Efficiency for many phosphors increases as the operating anode voltage increases; the required operating brightness can be achieved with lower power consumption at high voltage. To satisfactorily operate at high anode voltages, e.g., 4 kV or higher, the backplate containing the emitter array must be spatially separated from the faceplate, containing the phosphor pixels, by a distance sufficient to prevent unwanted electrical events between the two. This distance is typically greater than 0.5 mm.

Constrained by faceplate and backplate glass area and thickness, the vacuum envelope is unable to withstand 1 atmosphere or greater external pressure without inclusion of internal supports. If the internal supports are not included then the faceplate and backplate can collapse. In rectangular displays with greater than approximately a 1 inch diagonal, the faceplate and backplate are susceptible to this type of mechanical failure due to their high aspect ratio, which is defined as the larger dimension of the display divided by the thickness of the faceplate or backplate. The use of internal supports in the interior of the field emission device substantially eliminates this mechanical failure.

The faceplates and backplates for a desired flat, light portable display are typically about 1 mm thick. Internal supports, providing support in the interior of the display, may include an edge metallization layer to form an electrical connection between the internal supports and the backplate. However, charge can build up on the internal supports from sources including electrons back-scattered off of the faceplate. See WO patent application Ser. No. 94/18694, filed Feb. 1, 1994; assigned to the same assignee. This application is incorporated herein by reference.

As previously mentioned, there is usually a one-to-one correspondence between each group of field emitters and a phosphor subpixel. High energy electrons from the field emitters may become back scattered from their intended phosphor subpixel and strike another phosphor subpixel, which may be the wrong color. This reduces color purity and contrast. Additionally, these back scattered electrons can strike internal supports causing them to build up charge.

Back scattered electrons pose relatively insignificant problems in conventional CRT's or low voltage field emission displays. With conventional CRT's the phosphor is in a field free region. Scattered electrons are collected in the funnel, as illustrated in FIG. 1.

Lower voltage field emission displays, typically less than 1 kV, are not significantly affected by back scattered electrons.

In one low voltage display, all of the electrons are confined to one pixel by switching the neighboring pixels off, as illustrated in FIG. 2.

Higher voltage displays have been carbon coated to attenuate back scattering. However, this method gives less than a 2× improvement in contrast. J. J. van Oekel, "Improving the Contrast of CRTs under Low Ambient Illumination with a Graphite Coating", SID International Symposium, Digest of Technical Papers, 1st Ed., pp. 427–43 (May, 1995).

It would be desirable to provide a high voltage display with scattered electrons that has improved contrast and color purity. It would be further desirable in a high voltage display to reduce the number of scattered electrons that strike non-corresponding phosphor subpixels, or internal insulating and resistive surfaces (e.g., surfaces of internal supports). It would also be desirable to provide, in a high voltage display, a plurality of scattering shields, defining a subpixel volume, to reduce electron escape.

SUMMARY

Accordingly, an object of the invention is to provide a flat panel display with improved contrast and color purity.

Another object of the invention is to provide a high voltage flat panel display with a reduction of back scattered electrons that strike the wrong phosphor subpixel.

A further object of the invention is to provide a high voltage flat panel display with a reduction of back scattered electrons that charge up internal insulating or resistive structures.

Yet another object of the invention is to provide a flat panel display with a faceplate interior side that includes a plurality of scattering shields surrounding each phosphor subpixel and defining a subpixel volume.

Another object of the invention is to provide a flat panel display with scattering shields surrounding each phosphor subpixel, defining a subpixel volume. Scattered electrons are confined to the subpixel volume.

These and other objects of the invention are attained in a flat panel display which includes a faceplate with a faceplate interior side, and a backplate with a backplate interior side that is in an opposing relationship to the faceplate interior side. Side walls, positioned between the faceplate and the backplate, form an enclosed sealed envelope of the display. A plurality of phosphor subpixels are positioned at the faceplate interior side. A plurality of field emitters emit electrons which are accelerated to a corresponding phosphor subpixel. A plurality of scattering shields surround each phosphor subpixel. The scattering shields define a subpixel volume. The scattering shields reduce the number of scattered electrons able to escape from the subpixel volume.

The height of the scattering shields surrounding a phosphor subpixel is sufficient to reduce the number of scattered electrons exiting their corresponding subpixel volume and charging internal insulating surfaces in the envelope. Further, the height of the scattering shields is sufficient to reduce the number of scattered electrons from exiting the corresponding subpixel volumes and striking a non-corresponding subpixel.

The height of the scattering shields can be about 20 to 100 $\mu$m above phosphor, or above a top surface of an Al layer overlying the phosphor. Further, the height of the scattering shields can be about 20 to 200 $\mu$m above the phosphor.

The scattering shields can define a display internal structure that aligns field emitters to corresponding phosphor subpixels. One or more internal supports may be included in the envelope to support the backplate and the faceplate against forces acting in a direction toward the envelope. The scattering shields may be made of a photo patternable material including but not limited to polyimide. Further, the scattering shields may be at least partially formed of a black matrix material.

Inclusion of the scattering shields provides an improvement in contrast and color purity and reduces charging. The scattering shields substantially trap scattered electrons in their corresponding subpixel volumes.

DETAILED DESCRIPTION OF THE PREFERRED EMBODIMENTS

In the following description, embodiments of the invention are described with respect to a field emission device, more particularly, to a flat cathode ray tube display.

Herein, a flat panel display is a display in which a faceplate and backplate are substantially parallel, and the thickness of the display is small compared to the thickness of a conventional deflected-beam CRT display. The thickness of the display is measured in a direction substantially perpendicular to the faceplate and backplate. Often the thickness of a flat panel display is substantially less than about 2.0 inches and in one embodiment it is about 3.25 mm. For purposes of this disclosure, a high voltage display has electrons from field emitters accelerated to energies of from 1 keV to 10 keV.

The present invention is a flat panel display with a plurality of phosphor subpixels , and a plurality of oppositely positioned field emitters. The field emitters emit electrons which strike corresponding phosphor subpixels. A plurality of scattering shields surround each phosphor subpixel and define a subpixel volume. The scattering shields reduce the number of scattered electrons exiting from their corresponding subpixel volume. This reduces the number of scattered electrons from charging internal insulating surfaces in the envelope, as well as the number of electrons striking non-corresponding phosphor subpixels. This increases contrast, color purity and power efficiency in the high voltage display.

Figure 1:
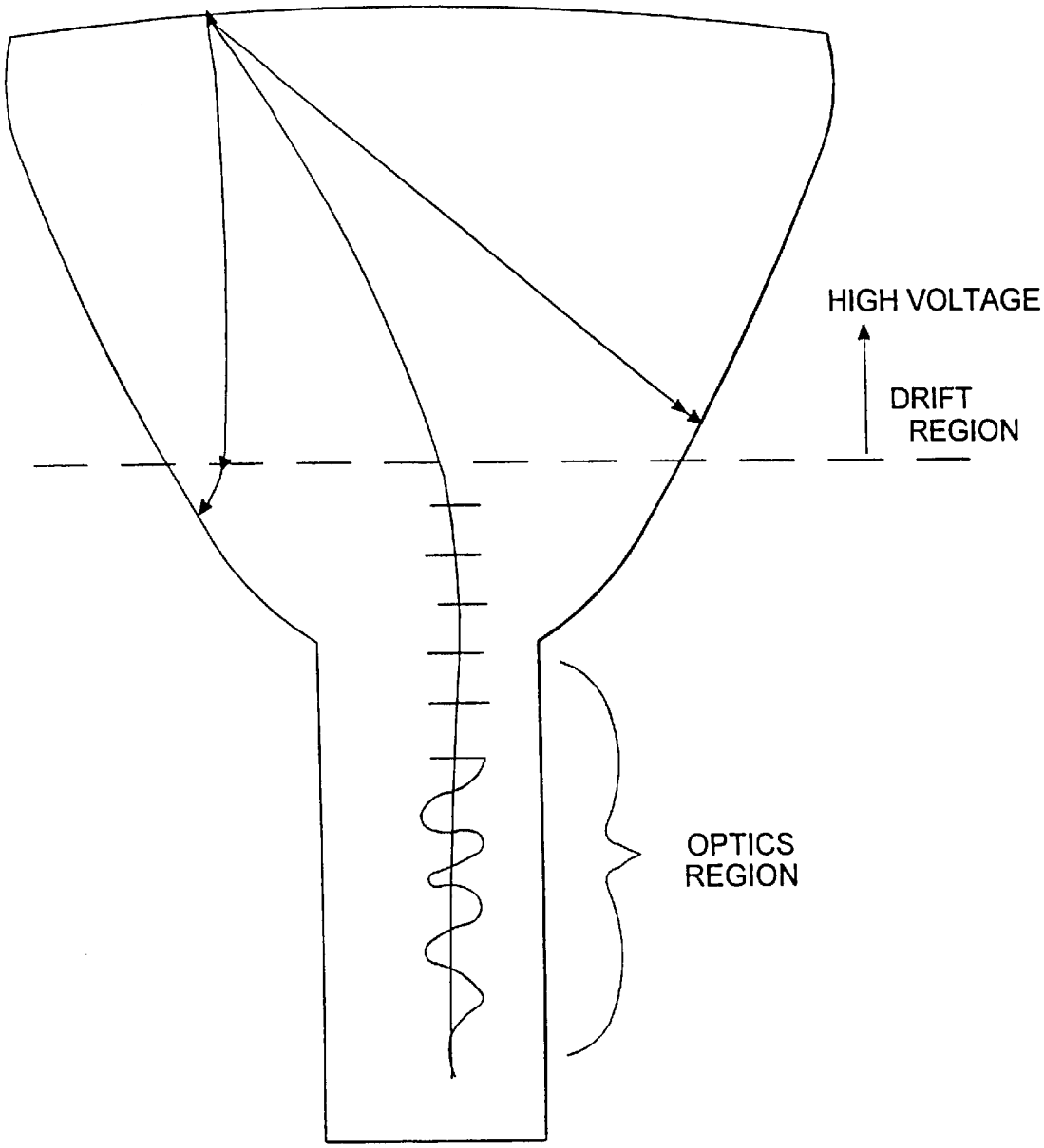
FIG.1 PRIOR ART
FIG. 1 is a diagram of a conventional CRT illustrating the collection of scattered electrons in the CRT funnel.
Figure 2:
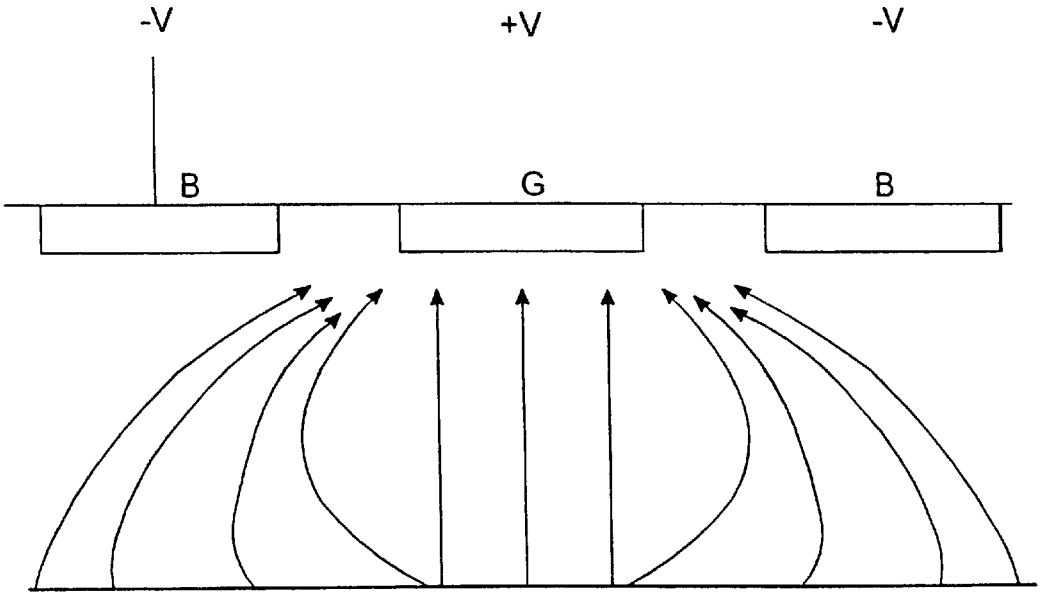
FIG.2 PRIOR ART
FIG. 2 is a diagram of a low voltage field emission display which confines all of the electrons to one phosphor subpixel by switching neighboring phosphor subpixels off.
Figure 3:
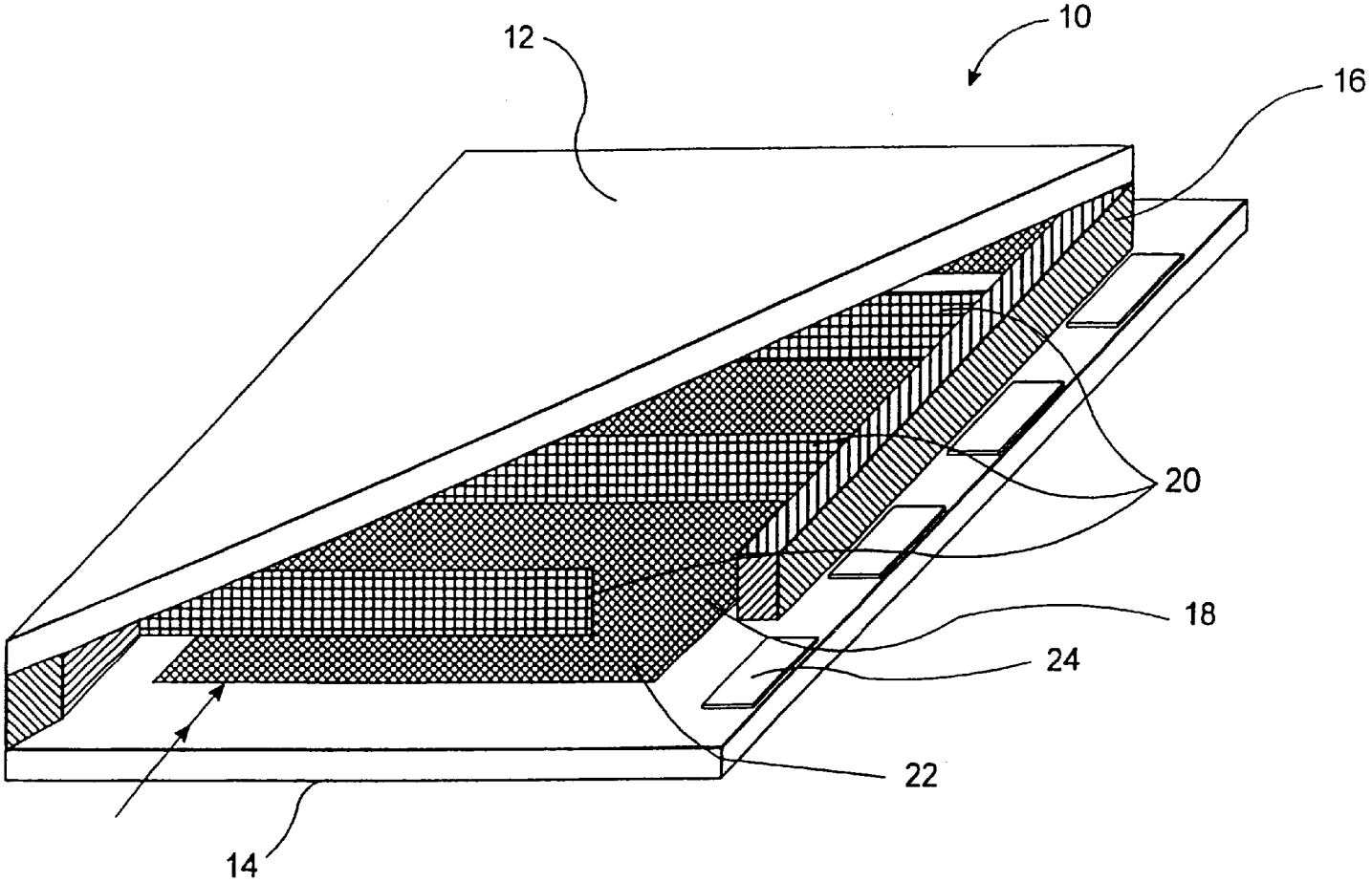
FIG. 3 is a perspective cutaway view of a flat panel display including a field emission cathode according to one embodiment of the invention.

Referring to FIG. 3, a flat panel display 10 includes a faceplate 12, backplate 14 and side walls 16, which together form a sealed envelope 18 held at vacuum pressure, e.g., approximately $1\times10^{-7}$ torr or less. One or more internal supports 20 support faceplate 12 against backplate 14. Internal supports 20 can include electrodes positioned along their longitudinal length. For purposes of this disclosure, internal supports 20 include walls, posts and wall segments.

A plurality of field emitters 22 are formed on a surface of backplate 14 within envelope 18. For purposes of this disclosure, field emitters 22 can include a plurality of field emitters or a single field emitter. Field emitters 22 can be filaments, cones and the like. Each field emitter 22 extends through an aperture in an insulating layer to contact an underlying emitter line. The top of each field emitter 22 is exposed through an opening in an overlying gate line. Row and column electrodes control the emission of electrons from field emitters 22. The electrons are accelerated toward a phosphor subpixel coated interior surface of faceplate 12 (the phosphor coated area constituting the "active region" of display 10). Integrated circuit chips 24 include driving circuitry for controlling the voltage of the row and column electrodes so that the flow of electrons to faceplate 12 is regulated. Electrically conductive traces are used to electrically connect circuitry on chips 24 to the row and column electrodes.

Figure 4:
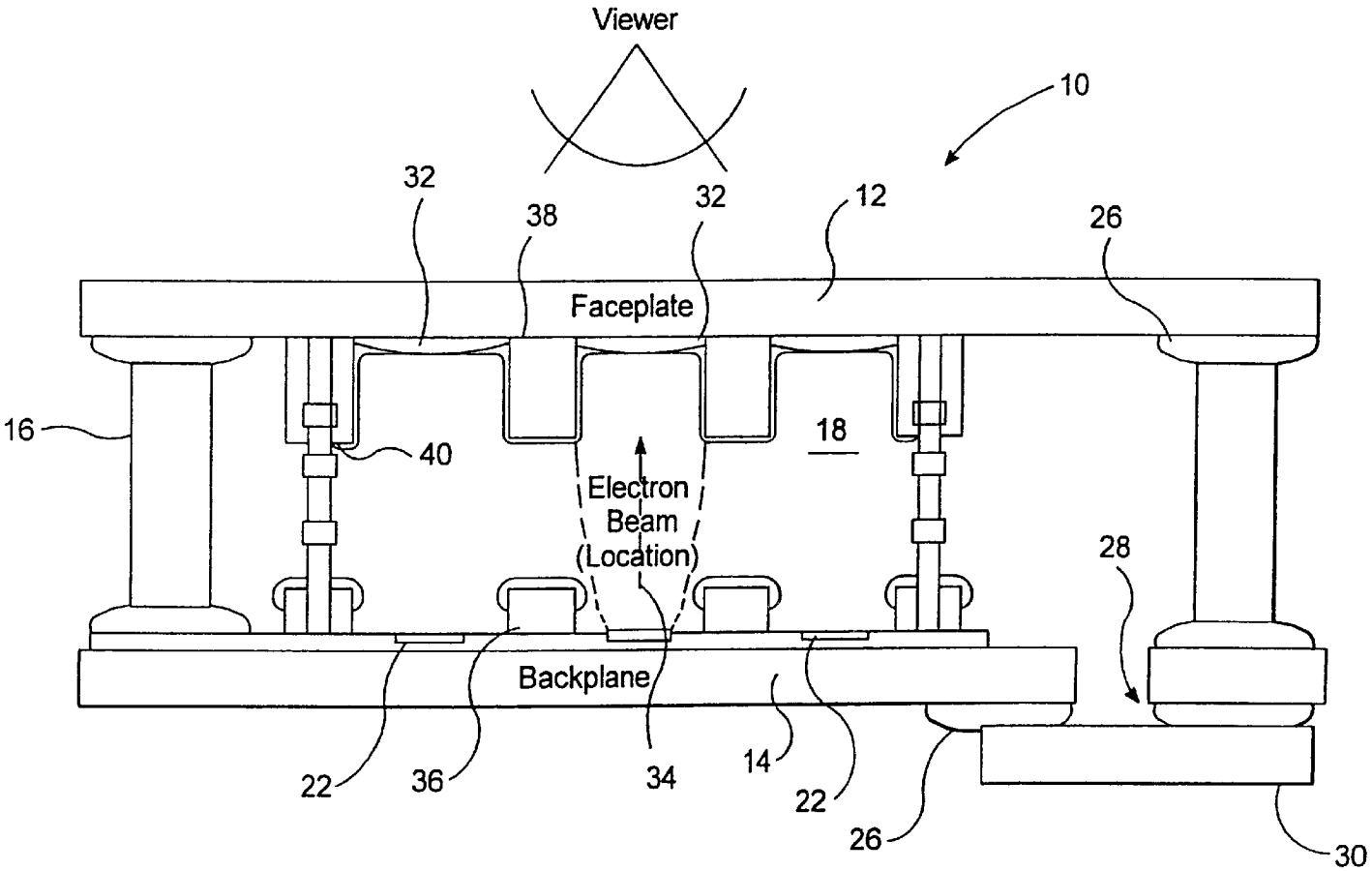
FIG. 4 is a cross-sectional view of part of a flat panel display according to an embodiment of the invention including field emitters, phosphor subpixels, and scattering shields.

Referring now to FIG. 4, faceplate 12 and backplate 14 consist of glass that is about 1.1 mm thick. A hermetic seal 26 of solder glass, including but not limited to OWENS-ILLINOIS® CV 120, attaches side walls 16 to faceplate 12 and backplate 14 to create sealed envelope 18. The entire display 10 must withstand a 450 degree C. sealing temperature. Within envelope 18 the pressure is typically 10-7 torr or less. This high level of vacuum is achieved by evacuating envelope 18 through pump port 28 at high temperature to cause absorbed gases to be removed from all internal surfaces. Envelope 18 is then sealed by a pump port patch 30.

Faceplate 12 includes a plurality of phosphor subpixels 32. Electrons defining an electron beam 34 are accelerated from a plurality of field emitters with energies in the range of 1 kV to 10 kV. Electron beam 34 is focused by focus grid 36 to strike a corresponding phosphor subpixel 32. There is a one-to-one correspondence between a set of field emitters 22, positioned within a section of focus grid 36, to a phosphor subpixel 32. Each phosphor subpixel 32 is surrounded by a plurality of scattering shields 38 which define a subpixel volume 40.

Figure 5:
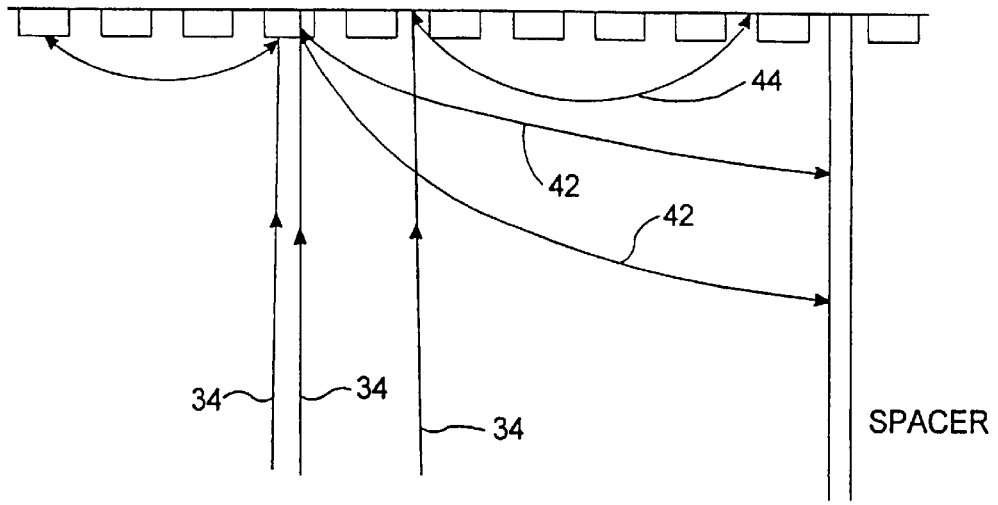
FIG. 5 is a schematic diagram of back scattered electrons in a display without scattering shields.

FIG. 5 illustrates the results with a black matrix but without scattering shields 38. Electrons in electron beam 34 are accelerated from a plurality of field emitters 22 to strike their corresponding phosphor subpixels 32. Some of these electrons are back scattered from a phosphor subpixel or an adjacent area to an internal support 20 as represented by ray 42. Other electrons are back scattered and strike non-corresponding phosphor subpixels, as shown with ray 44. Back scattered electrons can strike other insulating elements in envelope 18. Back scattering electrons onto resistive surfaces, such as internal supports 20, affects the ratio of brightness to power of display 10 by limiting the amount of current that can be used. Further, the back scattering onto internal supports 20 limits the height of internal supports 20 and thus the high voltage; Back scattering of electrons to non-corresponding phosphor subpixels reduces contrast and color purity of display 10. A black matrix typically has a low aspect ratio. Additionally, it is difficult to make a structure with a sufficient aspect ratio to prevent electrons escaping from their subpixel volume 40.

Figure 6:
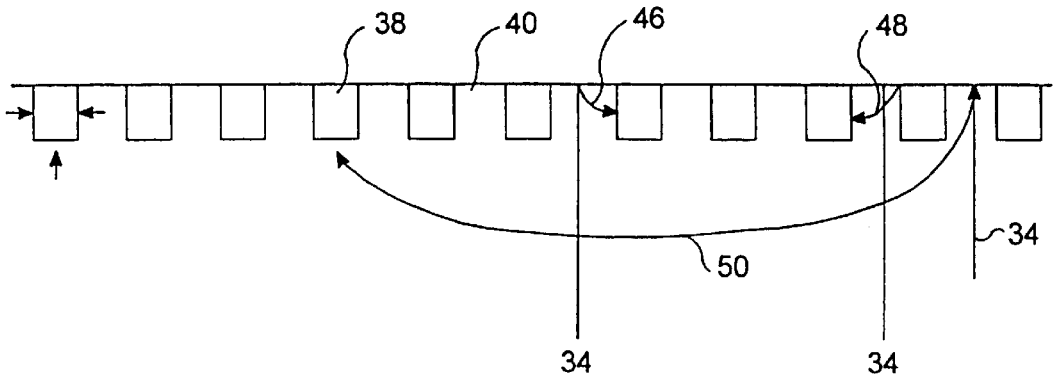
FIG. 6 is a schematic diagram illustrating the effect of scattering shields and back scattered electrons.

FIG. 6 the effects of scattering shields 38 are illustrated. Back scattered electrons strike scattering shields 38, represented by rays 46 and 48, and do not leave their scattering shield volumes 40. They remain essentially captured in their scattering shield volumes 40. Alternatively, if back scattered electrons escape from their scattering shield volume 40 scattering shields 38 capture the back scattered electrons as in the case of ray 50, preventing them from striking non-corresponding phosphor subpixels.

Figure 7:
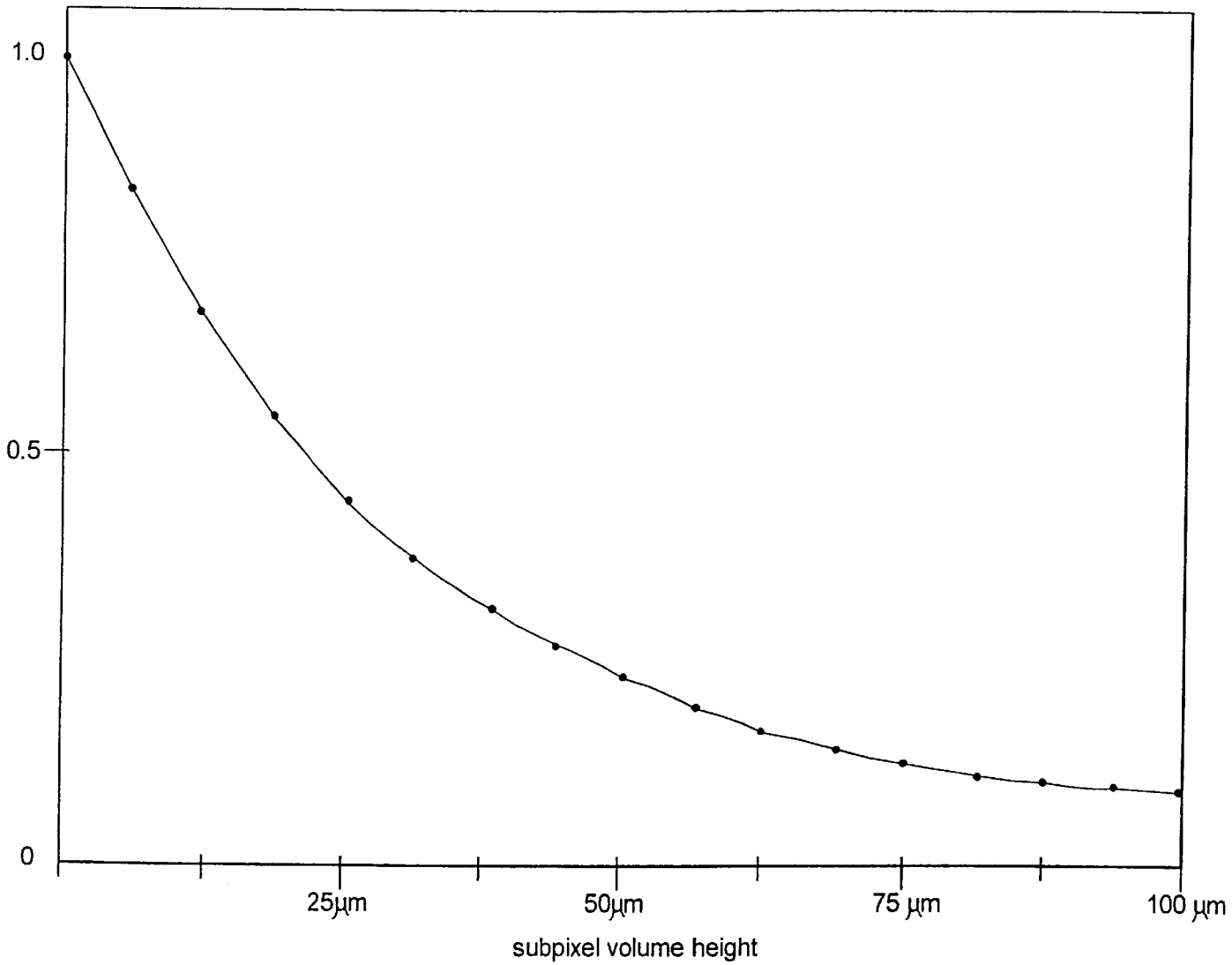
FIG. 7 is a graph of the fraction of current striking another phosphor subpixel verses the height of scattering shields for a typical display operated at 4 kV.

The height of scattering shields 38 is sufficient to reduce the number of scattered electrons which escape from a subpixel volume 40. Referring now to FIG. 7, the fraction of current striking another phosphor subpixel is shown as a function of scattering shield 38 height. Preferably, scattering shield 38 height is 12 $\mu$m, 25 $\mu$m, 25 $\mu$m. 50 $\mu$m, 75 $\mu$m, 100 $\mu$m or greater. However, the actual height and size will vary depending on dimensions of the display. Scattering shields 38 can have heights in the range of about 20 to 200 $\mu$m, 20 to 100 $\mu$m and 50 to 100 $\mu$m beyond a height of the phosphor subpixels 32. With a height of 100 $\mu$m, scattering shields 38 provide a fivefold improvement in contrast.

Scattering shields 38 can be made of a photo patternable material including but not limited to polyimide. At least a portion of scattering shields 38 can include a black matrix material.

Display 10 may also include at least one internal structure in envelope 18 that fixes and constrains faceplate 12 to backplate 14, and thus aligns a plurality of phosphor subpixels 32 with corresponding field emitters 22 to within a predetermined tolerance of 12 $\mu$m or less. This internal structure is a receiving trench, which can also grip and retain and in this instance be a wall gripper, formed on an internal side of faceplate 12, and a locator formed on an interior side of backplate 14. It will be appreciated that the locator can be formed on backplate 14, on faceplate 12 and on both faceplate 12 and backplate 14. An internal support 20 is mounted in the wall locator. It is important to provide precision alignment between scattering shields 38 and phosphor subpixels 32; focus grid 36 and field emitters 22; and focus grid 36 and scattering shields 38. The structure is thereafter held in place without movement during the thermal assembly process.

Referring now to field emitters 22, a patterned field emission structure is included in backplate 14. The field emission structure consists of, (i) a plurality of field emitters 22, (ii) a patterned metallic emitter electrode, generally known as base electrode, divided into a group of substantially identical straight emitter lines, (iii) a metallic gate electrode divided into a group of substantially identical straight gate-electrode lines and (iv) an electrically insulating layer.

Emitter lines are positioned on the interior surface of backplate 14, extend parallel to each other at a uniform spacing, have a center-to-center spacing of about 315 to 320 $\mu$m and can be formed of nickel or chromium with a thickness of about 0.5 $\mu$m and a width of 100 $\mu$m. An insulating layer lies on the emitter-electrode lines and on laterally adjoining portions of backplate 14. The insulating layer can consist of silicon dioxide with a thickness of about 1 $\mu$m or less. The gate-electrode lines are positioned on the insulating layer and extend parallel to one another at a uniform spacing. Their center-to-center spacing is typically about 105 to 110 $\mu$m, and they extend perpendicular to the emitter lines. Gate lines can be formed of nickel with a thickness of about 0.02 to 0.5 $\mu$m and a width of about 30 $\mu$m.

Internal supports 20 have a sufficiently small thickness so they provide minimal interference with the operation of display 10, particularly field emitters 22 and phosphor subpixels 32 of the device. Internal supports 20 are preferably made of a ceramic, glass or glass-ceramic. Other materials include ceramic reinforced glass, devitrified glass, amorphous glass in a matrix, metal with an electrically insulating coating, bulk resistivity materials such as a titanium aluminum chromium oxide, vacuum compatible polyimides or insulators such as silicon nitride. Internal supports 20 have a thickness of about 20 to 60 $\mu$m, and a center-to-center spacing of about 8 to 10 mm. Internal supports 20 maintain spacing between faceplate 12 and backplate 14 at a substantially uniform value across the entire active area of the display.

One embodiment of the process for forming scattering shields 38 and a wall locator is now described.

A layer of lacquer is sprayed on phosphor subpixels 32. The upper surface of the lacquer layer is smooth. A light reflecting layer can be evaporatively deposited on the lacquer layer. The structure is then heated at approximately 450 degrees C. for 60 minutes in a partial oxygen atmosphere to burn out the lacquer.

A preferred material for scattering shields 38 is a photodefinable polyimide, such as OCG PROBIMIDE® 7020 or other similar polymers from DuPont, Hitachi and the like.

A first layer of PROBIMIDE® 7020 is deposited by conventional spin deposition at 750 RPM for 30 seconds. Faceplate 12 is then baked on a hot plate at 70 degrees C., followed by 100 degrees C. soft bake, to drive off solvents. A black matrix pattern is created by, (i) photoexposure through a mask in proximity to the PROBIMIDE® layer, (ii) development of the PROBIMIDE® layer, followed by (iii) baking at 450 C. The Probimide is then developed in OCG QZ3501 by a puddle/spray cycle: followed by a solvent rinse (OCG QZ 3512).

A second layer of PROBIMIDE® 7020 is deposited and baked under the same conditions as the first layer. The soft baked PROBIMIDE® is then photoexposed by 405 nm light through a mask in proximity to the PROBIMIDE® layer. The exposed probimide layer is then stabilized.

The developed wall locator is then hard baked for 1 hour at 450 degrees C. in a nitrogen atmosphere with a thermal ramp of 3 degrees C. per minute.

Internal supports 20 are then inserted into the wall locator. The insertion axis of internal supports 20 is perpendicular to the plane of faceplate 12. Insertion can also be accomplished parallel to the plane of faceplate 12. Internal support 20 extends beyond scattering shields 38 in an amount sufficient to secure one of its ends with solder glass to substrate 12.

Internal support 20 is held in place with only one end secured by a solder glass or other high temperature adhesives. Other suitable adhesives include, but are not limited to polyimide and the like. Solder glass can be, but is not limited to, OI CV 120. The assembly is then baked for one hour at 450 degrees C. to devitrify the solder glass. A suitable oven ramp is 3 degrees C. per minute. Securing one end of internal support 20 provides mechanical stability of internal support 20 for subsequent processing. Additionally, since there is differential expansion and contraction during thermal processing, when internal supports 20 are secured or pinned at both ends buckling of internal support 20 results. Securing internal support 20 at only one end enables the use of materials with substantially different coefficients of thermal expansion for internal supports 20, faceplate 12 and backplate 14.

It is possible to tack internal supports 20 with a laser in combination with cured solder glass. A perimeter frit, in bar form, is cured with the laser in a vacuum oven (final seal).

It will be appreciated that the present invention is not limited to the preceding example of a process cycle. The present invention can be created with various modifications of this process cycle.

Scattering shields 38 can also be created from black chromium and photopatterned by conventional lithography on faceplate 12.

The foregoing description of preferred embodiments of the present invention has been provided for the purposes of illustration and description. It is not intended to be exhaustive or to limit the invention to the precise forms disclosed. Obviously, many modifications and variations will be apparent to practitioners skilled in this art. The embodiments were chosen and described to best explain the principles of the invention and its practical application. This thereby enables others skilled in the art to understand the invention for various embodiments and with various modifications as are suited to the particular use contemplated. It is intended that the scope of the invention be defined by the following claims and their equivalents.

What is claimed is:

1. A flat panel display, comprising:

a faceplate including a faceplate interior side;

a backplate including a backplate interior side in an opposing relationship to the faceplate interior side;

side walls positioned between the faceplate and the backplate to form an enclosed sealed envelope between the side walls, backplate interior side and the faceplate interior side;

a voltage equal to or greater than 1 kV applied between the backplate and the faceplate;

a plurality of phosphor subpixels positioned at the faceplate interior side;

a plurality of field emitters that emit electrons which are directed to a corresponding phosphor subpixel; and a plurality of scattering shields surrounding each phosphor subpixel and defining a subpixel volume, the scattering shields reducing a number of scattered electrons in the subpixel volume from escaping from the subpixel volume, wherein the height of the scattering shields surrounding a phosphor subpixel is at least 75 $\mu$m from the faceplate interior side.

2. The display of claim 1, further comprising:

an internal support within the envelope adjacent to the faceplate, at least a portion of the internal support having an insulating surface on an exterior of the internal support, the height of the scattering shields surrounding a phosphor subpixel being sufficient to reduce the number of scattered electrons from exiting from their corresponding subpixel volume to strike and charge the insulating surface.

3. The display of claim 1, wherein the height of the scattering shields surrounding a phosphor subpixel is sufficient to reduce the number of scattered electrons exiting from their corresponding subpixel volume to strike another phosphor subpixel.

4. The display of claim 1, wherein the height of the scattering shields is about 20 to 100 $\mu$m beyond the phosphor subpixels.

5. The display of claim 1, wherein the phosphor subpixels have a height that extends about 1 to 30 $\mu$m from the faceplate interior side into the envelope.

6. The flat panel display of claim 5, wherein the scattering shields extend about 20 to 100 $\mu$m beyond the phosphor subpixels.

7. The flat panel display of claim 5, wherein the scattering shields have a height of about 50 $\mu$m extending beyond the phosphor subpixels.

8. The flat panel display of claim 5, wherein the scattering shields have a height of about 75 $\mu$m extending beyond the phosphor subpixels.

9. The flat panel display of claim 5, wherein the scattering shields have a height of about 100 $\mu$m extending beyond the phosphor subpixels.

10. The display of claim 1, further comprising:

at least one internal support in the envelope supporting the backplate and the faceplate against forces acting in a direction toward the envelope.

11. The display of claim 1, wherein the scattering shields surrounding a phosphor subpixel are of sufficient height to reduce the number of scattered electrons escaping from their corresponding subpixel volume to strike and charge the internal support.

12. The display of claim 1, wherein the scattering shields are made of a material selected from the group consisting of polyimide, metal, glass and ceramic.

13. The display of claim 1, wherein a voltage less than 3 kV is applied between the backplate and the faceplate.

14. The display of claim 1, wherein a voltage equal to or greater than 3 kV is applied between the backplate and the faceplate.

15. The display of claim 1, wherein a voltage equal to or greater than 5 kV is applied between the backplate and the faceplate.

16. The display of claim 1, wherein a voltage equal to or greater than 7 kV is applied between the backplate and the faceplate.

17. The display of claim 1, wherein a voltage applied between the backplate and the faceplate is about 10 kV.

18. A flat panel display, comprising:

a faceplate including a faceplate interior side;

a backplate including a backplate interior side in an opposing relationship to the faceplate interior side;

side walls positioned between the faceplate and the backplate to form an enclosed sealed envelope between the side walls, backplate interior side and the faceplate interior side, the faceplate, backplate and side walls defining a display envelope with at least one internal support, at least a portion of the internal support having an insulating surface on an exterior of the internal support;

a plurality of phosphor subpixels positioned at the faceplate interior side;

a plurality of field emitters that emit electrons which are directed to a corresponding phosphor subpixel;

a plurality of scattering shields surrounding each phosphor subpixel and defining a subpixel volume, the scattering shields reducing a number of scattered electrons in the subpixel volume from escaping from the subpixel volume, wherein the height of the scattering shields surrounding a phosphor subpixel is at least 75 $\mu$m from the faceplate interior side to reduce the number of scattered electrons from exiting from their corresponding subpixel volume to strike and charge the insulating surface; and a locating groove formed in a column or row guard band, the locating groove adapted to receive an internal support and mount it relative to the phosphor subpixels.

19. The display of claim 18, wherein the height of the scattering shields surrounding a phosphor subpixel is sufficient to reduce the number of scattered electrons exiting from their corresponding subpixel volume to strike another phosphor subpixel.

20. The display of claim 18, wherein the height of the scattering shields is about 20 to 200 $\mu$m beyond the phosphor subpixels.

21. The display of claim 18, wherein the height of the scattering shields is about 20 to 100 $\mu$m beyond the phosphor subpixels.

22. The display of claim 18, wherein the phosphor subpixels have a height that extends about 1 to 30 $\mu$m from the faceplate interior side into the envelope.

23. The display of claim 1, wherein the scattering shields extend about 20 to 200 $\mu$m beyond the phosphor subpixels.

24. The flat panel display of claim 22, wherein the scattering shields have a height of about 12 $\mu$m extending beyond the phosphor subpixels.

25. The flat panel display of claim 22, wherein the scattering shields have a height of about 25 $\mu$m extending beyond the phosphor subpixels.

26. The flat panel display of claim 22, wherein the scattering shields have a height of about 50 $\mu$m extending beyond the phosphor subpixels.

27. The flat panel display of claim 22, wherein the scattering shields have a height of about 75 $\mu$m extending beyond the phosphor subpixels.

28. The flat panel display of claim 22, wherein the scattering shields have a height of about 100 $\mu$m extending beyond the phosphor subpixels.

29. The display of claim 18, further comprising:

at least one internal support in the envelope supporting the backplate and the faceplate against forces acting in a direction toward the envelope.

30. The display of claim 18, wherein the scattering shields surrounding a phosphor subpixel are of sufficient height to reduce the number of scattered electrons escaping from their corresponding subpixel volume to strike and charge the internal support.

31. The display of claim 18, wherein the scattering shields are made of a material selected from the group consisting of polyimide, metal, glass and ceramic.

32. The display of claim 18, wherein a voltage equal to or greater than 1 kV is applied between the backplate and the faceplate.

33. The display of claim 18, wherein a voltage equal to or greater than 3 kV is applied between the backplate and the faceplate.

34. The display of claim 18, wherein a voltage equal to or greater than 5 kV is applied between the backplate and the faceplate.

35. The display of claim 18, wherein a voltage equal to or greater than 7 kV is applied between the backplate and the faceplate.

36. The display of claim 18, wherein a voltage applied between the backplate and the faceplate is about 10 kV.

* * * * *